US007380389B2

(12) United States Patent
Anderson

(10) Patent No.: US 7,380,389 B2
(45) Date of Patent: Jun. 3, 2008

(54) BOTTOM PRE-FOLDER FOR CARTON WITH FOLDED-IN GUSSET TIPS

(75) Inventor: Paul J. Anderson, Woodbury, MN (US)

(73) Assignee: Tetra Laval Holdings & Finance, SA, Pully (CH)

( * ) Notice: Subject to any disclaimer, the term of this patent is extended or adjusted under 35 U.S.C. 154(b) by 36 days.

(21) Appl. No.: 11/379,002

(22) Filed: Apr. 17, 2006

(65) Prior Publication Data

US 2007/0243986 A1 Oct. 18, 2007

(51) Int. Cl.
*B65B 43/26* (2006.01)

(52) U.S. Cl. ..... 53/565; 53/458

(58) Field of Classification Search ..... 53/565, 53/568, 452, 458; 493/164, 175, 454
See application file for complete search history.

(56) References Cited

U.S. PATENT DOCUMENTS 3,999,469 A * 12/1976 Nilsson ..... 493/164
4,109,975 A * 8/1978 Mattson ..... 384/222
4,308,020 A * 12/1981 Langen ..... 493/175
4,589,862 A * 5/1986 Murrah ..... 493/183
4,708,706 A * 11/1987 Doderer et al. ..... 493/295
5,681,253 A * 10/1997 Owen et al. ..... 493/183
6,385,950 B1 * 5/2002 Anderson ..... 53/563
6,626,810 B1 * 9/2003 Bressler et al. ..... 493/176
7,147,145 B2 * 12/2006 Kortsmit et al. ..... 229/137

* cited by examiner

*Primary Examiner*—Sameh H. Tawfik
(74) *Attorney, Agent, or Firm*—Levenfeld Pearlstein, LLC

(57) ABSTRACT

A bottom prefolding assembly prefolds the bottom panels of a package having a bottom wall formed with in-folded gusset tips. The prefolding assembly infolds the bottom gusset panels, leading and trailing panels of a carton and in-folds the gusset panel tips prior to forming the sealed carton bottom. The assembly includes a drive, first and second folding arms configured to contact and inwardly prefold the lead and trailing panels and a forming arm movable with the first and second folding arms. The forming arm has a pair of pivotable finger elements mounted thereto. The finger elements each having a carton engaging portion to engage the panel portions that form the gusset tips and fold the panel portions in a direction opposite of the folding of the gusset panels.

8 Claims, 6 Drawing Sheets

BOTTOM PRE-FOLDER FOR CARTON WITH FOLDED-IN GUSSET TIPS

BACKGROUND OF THE INVENTION

The present invention pertains to a pre-folding device for carton bottoms. More particularly, the present invention pertains to an apparatus for pre-folding carton bottom flaps for cartons having folded-in gusset tips.

Gable top cartons are widely used for packaging milk, juice and the like. Recently, packaging technology has made enormous strides vis-à-vis these gable top cartons, as well as other types of packages. Present technology permits packaging perishable food items for non-refrigerated extended shelf lives. These packages provide the ability to bring these food items into parts of the world that have limited transportation, distribution and storage infrastructure.

As such, efforts have been focused on increasing the ability to maintain high levels of cleanliness in forming, filling and sealing containers to provide the highest quality product and to provide the greatest product shelf life. In conjunction with these efforts, the demands on packaging machines have become greater, in particular, relative to operating speeds. Such machines must form, fill and seal packages, in a sterile environment, at high operating speeds.

To maintain the integrity of the package after it is filled and sealed, advanced technologies have been applied to the carton materials, as well as the processing operations. Many such packaging materials are formed from paperboard or fiberboard-based materials formed in a composite structure. Typically, one or more layers, such as polymeric coatings, foil coatings and the like, are applied to the paperboard or fiberboard substrate to reduce or eliminate the gas and liquid permeability of the substrate material.

It has been found that one avenue for promoting an environment that reduces the shelf life is wicking of the food product into the package material. Wicking occurs at the edges of the material that are exposed to the food product. Often, wicking occurs at the raw or exposed edges of the bottom wall panels as they are folded to form the bottom wall. To this end, it has been found desirable to reduce the amount or extent of exposed edges, and in particular at the bottom wall. It has also been found that foil at the tips of the gussets (the in-folded triangular panels) can crack thus exposing the paperboard substrate.

One package that has affected such a reduction is disclosed in U.S. Pat. No. 6,328,204 to Stacy-Ryan and an apparatus to form such an over-folded bottom is disclosed in U.S. Pat. No. 6,385,950 to Anderson, both of which patents are commonly assigned with the present application and are incorporated herein by reference. While this over-folded bottom served to "cover" the exposed edge from the bottom front or rear panel, the infolded side panels (those panels that form the triangles when folded in) have edges that can remain exposed.

A package that overcomes these drawbacks is disclosed in copending U.S. patent application Ser. No. 11/163,657, entitled "Carton With Folded-In Gusset Tips", filed Oct. 26, 2005, commonly owned with the present application and incorporated herein by reference. One machine is known for carrying out the folded in gusset tips of the carton. However, this machine contacts the carton on the interior surfaces to fold the gusset tips after the carton (polymeric coating) has been heated. This resulted in the accumulation of polymer on the folding gusset folding elements which in turn caused increased maintenance.

Accordingly, there exists a need for a carton bottom pre-folding device for pre-folding or pre-breaking cartons having bottoms with folded in gusset tips. Desirably, such a device can be fitted within known form, fill and seal machines. More desirably, such a pre-folding device can accommodate carton folding operations at the operating speeds of known filling machines

BRIEF SUMMARY OF THE INVENTION

A bottom prefolding assembly prefolds the bottom panels of a package having a bottom wall having in-folded gusset tips. The prefolding assembly is configured to infold the bottom gusset panels, leading panel and trailing panel of a carton and to in-fold the gusset panel tips of the bottom wall prior to forming the sealed carton bottom.

The prefolding assembly includes a drive, first and second folding arms configured to contact and inwardly prefold the leading and trailing panels. A forming arm is operably connected to the drive and is movable with the first and second folding arms. The forming arm has a pair of pivotable finger elements mounted thereto. The finger elements each have a carton engaging portion to engage the panel portions that form the gusset tips and fold the panel portions in a direction opposite of the folding of the gusset panels.

In a present prefolder, the forming arm rotates about an axis and the finger elements each pivot about axes that are parallel to and spaced from one another and generally transverse to the forming arm axis.

The carton engaging portions are formed as slot regions for receiving the panel portions that form the gusset tips. The slots define spaced apart, parallel planes in which the panel portions that form gusset tips lie. The axes about which the finger elements pivot are outside of the planes of the panel portion (and the slots). The fingers can be biased outwardly to align the slot regions with the panel portions when the panel portions are in a non-folded state.

A drive linkage operably connects the drive to the first and second folding arms and the forming arm. The folding arms are disposed to rotate about axes spaced from and parallel to one another and the forming arm is disposed to rotate about an axis spaced from and parallel to the first and second folding arm axes. A flexible drive element, such as a drive belt, engages the first or second folding arm and the forming arm. In such a configuration, the other folding arm is operably connected to the forming arm.

A form, fill and seal packaging machine having the bottom panel pre-folder is also disclosed.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein:

FIGS. 4A-4D are a series of sequential illustrations of the prefolder, in which FIG. 4A illustrates the carton bottom presented to the prefolder, FIG. 4B shows the prefolder actuating with the folding arms moving inward toward the leading an trailing panels and the forming arm moving inward toward the gusset panels, FIG. 4C illustrates the folding and forming arms contacting their respective flaps, and FIG. 4D is an enlarged, partial view of one of the finger elements contacting and folding the gusset tip;

DETAILED DESCRIPTION OF THE INVENTION

Figure 1:
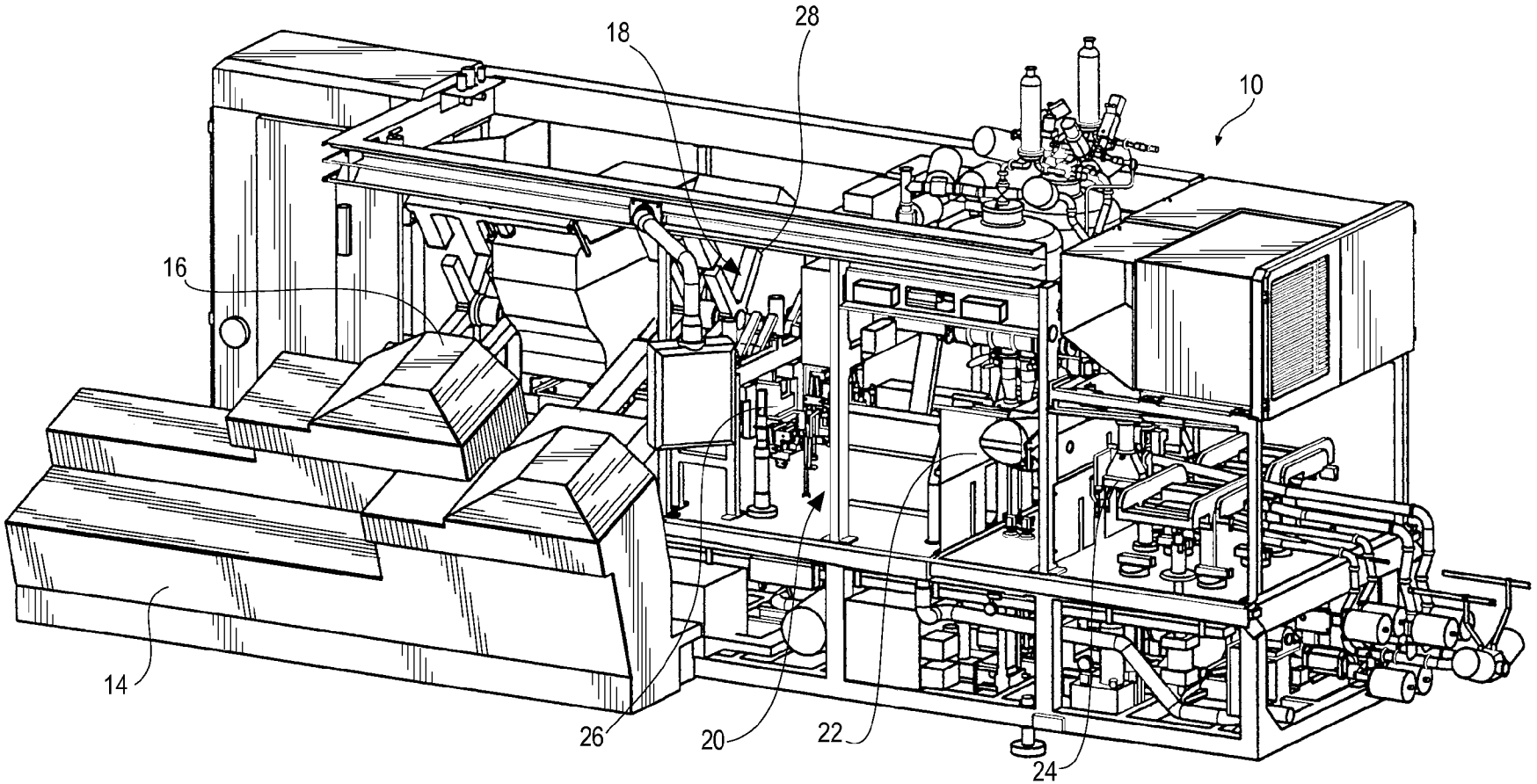
FIG. 1 is a perspective view of a form, fill and seal packaging machine having a bottom prefolder embodying the principles of the present invention that is configured to form a carton having folded-in gusset tips.
Figure 2:
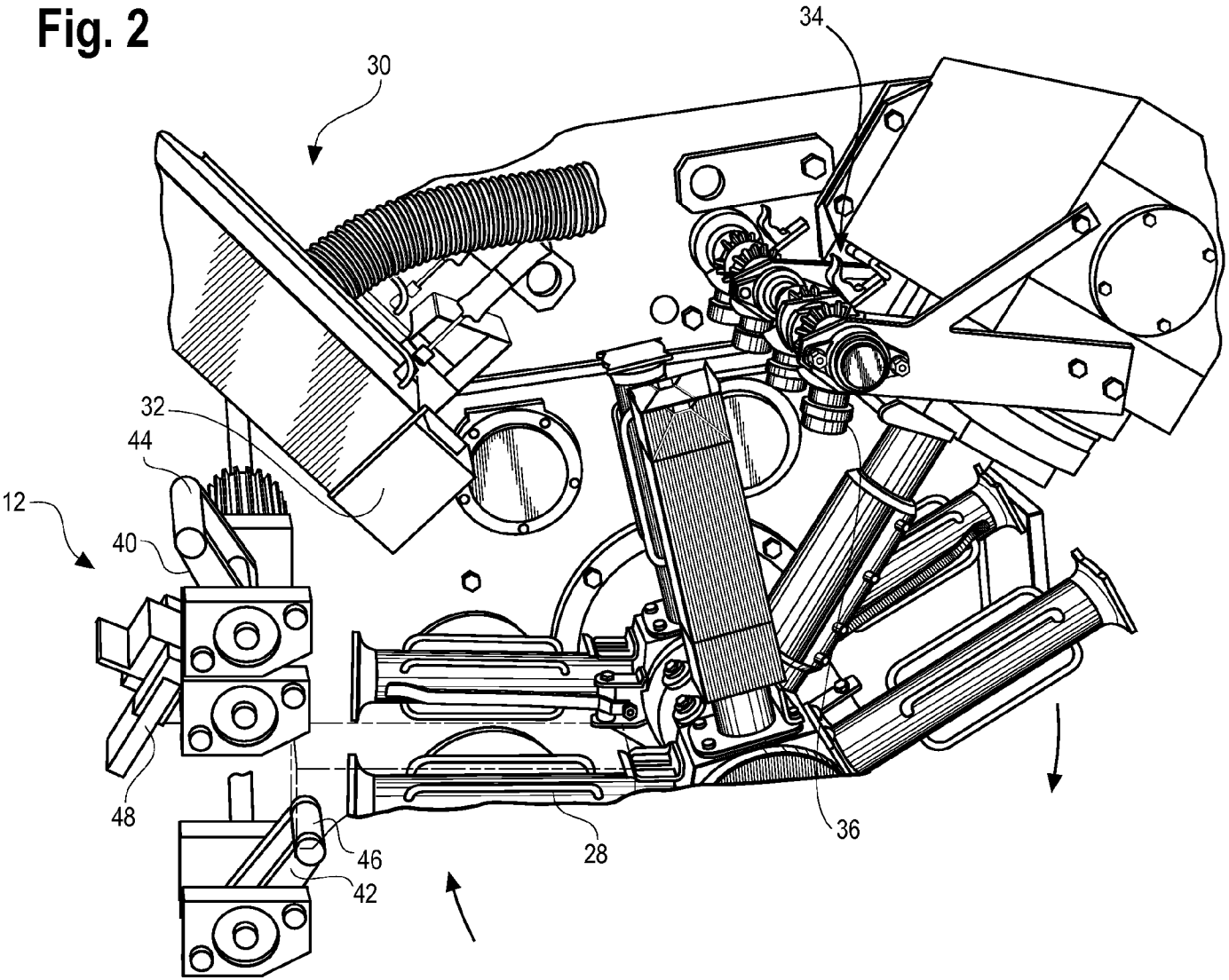
FIG. 2 is a partial perspective view of the machine mandrel, illustrating the location of the prefolder.
Figure 3:
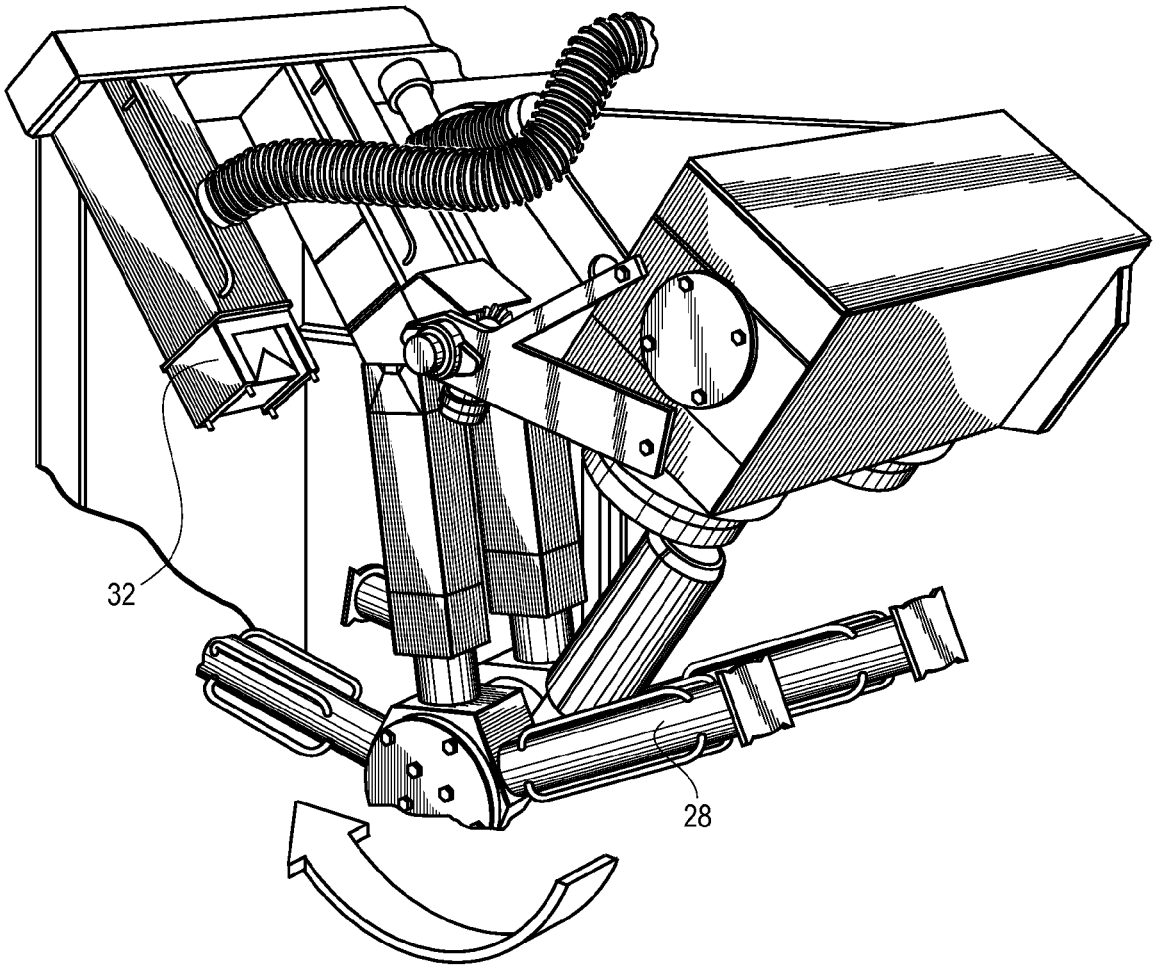
FIG. 3 is an illustration of the heater and folding sections of the machine (at the mandrel)
Figure 4A:
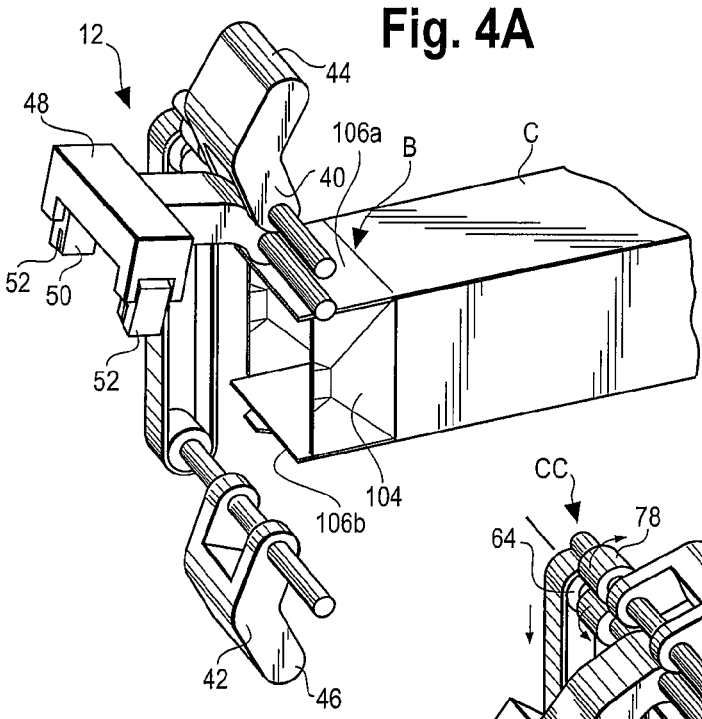
Figure 4B:
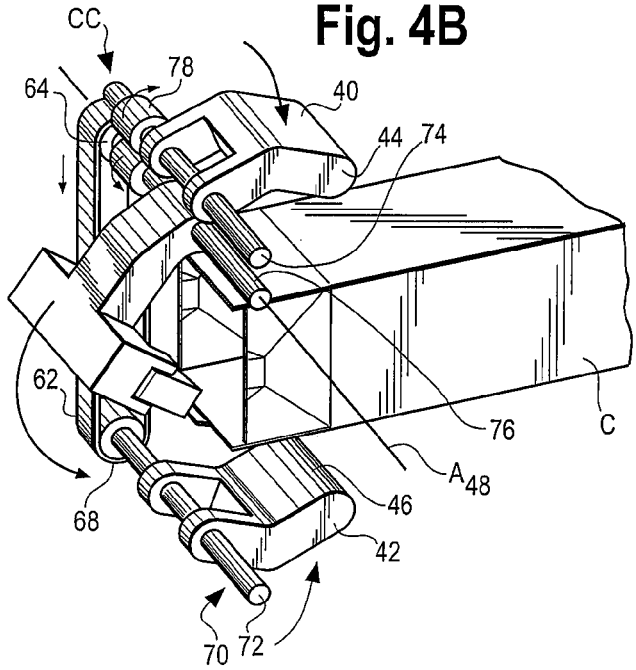
Figure 4C:
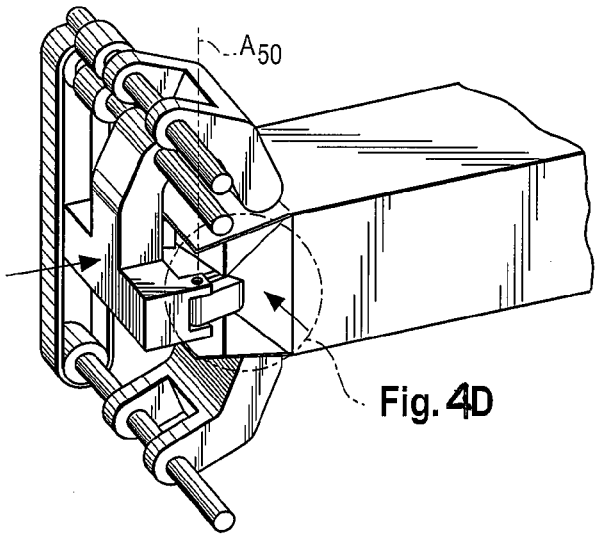
Figure 4D:
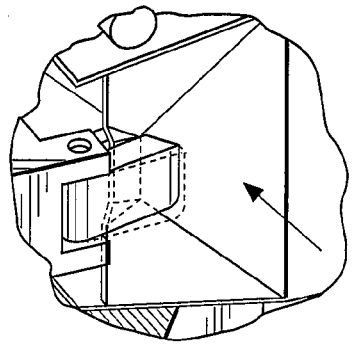

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to the figures, and in particular to FIG. 1, there is shown a form, fill and seal packaging machine 10 that includes a bottom pre-folding assembly 12 in accordance with the principles of the present invention. One example of a packaging machine 10 (without the present bottom folding assembly) is disclosed in U.S. Pat. No. 6,012,267 to Katsumata which patent is incorporated herein by reference.

The packaging machine 10 includes generally, a carton magazine 14 for storing flat, folded carton blanks, a carton erection station 16 and a bottom forming and sealing station 18. The bottom pre-folding assembly 12 is formed as part of the bottom forming and sealing station 18.

The machine 10 can further include a sterilization station 20 for sterilizing the cartons C and further includes a filling station 22 at which the cartons C are filled with product. Following the filling station 22, the carton top panels are pre-folded and subsequently folded and sealed at a top folding and sealing station 24. The cartons C are then off loaded from the form, fill and seal packaging machine 10. The packaging machine 10 illustrated includes a conveyor 26 for transporting a series of cartons C (in a two at a time, side-by-side manner) to and through each of the stations.

At the bottom forming and sealing station 18, the carton C is loaded onto a mandrel 28 that rotates through a plurality of stations (or substations) at which the panels, indicated at 100, generally, are first pre-folded at the panel creases 102. The bottom end portion B of the carton C is then heated so that the polymeric coating on the carton softens. The panels 100 are then folded with the side or triangular gusset panels 104 folded inward and the carton leading and trailing panels 106*a,b* folded over the gusset panels 104. As part of the leading and trailing panel 106*a,b* folding, a sixth or tab panel 108 is folded outward (to lie between the leading and trailing panels 106*a,b*) to eliminate an area of exposure of raw edge material to the product in the package C.

A carton C (formed using the present bottom pre-folder) in which the bottom wall has folded-in gusset tips is shown generally in FIGS. 8-12. One such carton C is disclosed in copending U.S. patent application Ser. No. 11/163,657, entitled "Carton With Folded-In Gusset Tips", filed Oct. 26, 2005, commonly owned with the present application, and incorporated herein by reference.

Figure 11:
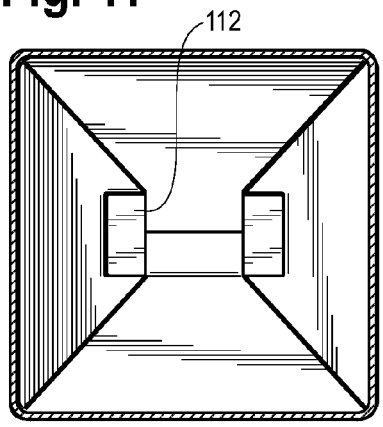
FIG. 11 is a view of the bottom of a folded and sealed carton as seen from the inside of the carton.
Figure 12:
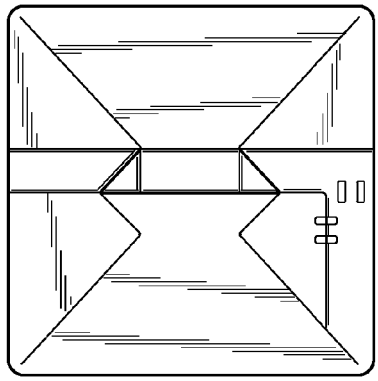
FIG. 12 is a view of the bottom of the folded and sealed carton as seen from the outside of the carton.

The bottom B wall is formed from the in-folded side gusset panels 104 and the front and rear or leading and trailing panels 106*a,b*. As seen in FIG. 11, as viewed from the inside of the carton C, the tips 110 of the infolded triangular or gusset panels 104 are folded over or folded in, so that they lie under the triangular panels 104, between the panels 104 and the leading and trailing bottom panels 106*a,b*. The gusset panels 104 thus appear to have a truncated triangular shape, and define a folded over edge (indicated at 112). The tab or sixth panel 108 is folded over so that the raw or uncoated edge of the trailing panel 106*b* is also outside of the product storage or wetted region.

The blank (not shown) for this package has a plurality of bottom panels 100, specifically the gusset panels 104, the leading panel and the trailing panel 106*a,b* and the sixth panel 108 that are partitioned from corresponding side panels and from adjacent bottom panels by the plurality of score lines or creases 102.

The bottom gusset panels 104 each have diagonal score lines 114 for folding the bottom panels 104, 106*a,b* inward during the bottom B wall forming process. The sixth panel or tab 108 is partitioned from bottom panel 106*a* by a horizontal score line 116. The major diagonal score lines 114 terminate at a folding region 118 that includes a rectangular area 120 having smaller triangular areas 122 adjacent to the sides of the rectangular area 120. The areas 120, 122 are defined by a first horizontal score line 124 contiguous with a pair of spaced apart vertical score lines 126. The major diagonal score lines 114 terminate at the corners of the U or at the respective junctures of the horizontal and vertical score lines 124, 126. To accommodate the in-folding of the tips 110, each of the bottom gusset panels 104 includes a pair of minor diagonal score lines 128 that extend from the edge of the panel to the respective junctures (corners) of the horizontal and vertical score lines 124, 126 with the major diagonal score lines 114.

Returning now to a description of the packaging machine 10, cartons C are erected and placed on the machine mandrel 28 (two shown) for indexing through the processing substations, including the pre-folding station 12 at which the bottom panel creases 102 and in particular the gusset panel creases 114, 124-128 are pre-folded or "broken", a heating station 30 at which a heater 32 heats the bottom panels 100 for sealing, and on to the sealing station 34, at which the bottom panels 100 are folded and sealed to one another. An exemplary bottom panel folding and sealing station 34 (having rotating folding fingers 36) is described in Anderson, U.S. Pat. No. 6,385,950, commonly owned with the present application and incorporated herein by reference.

The pre-folder 12 is mounted prior to the heating station 30. As will be appreciated by those skilled in the art, properly pre-folding the gusset panels 104 and specifically the gusset tip 110 panels (along crease lines 124, 126, 128), requires some instance of contact with the interior surfaces of the carton C. Although it is desirable, from a hygienic perspective to not contact these surfaces, contact with the food contacting surfaces can be minimized if not fully negated by the present pre-folder 12. Moreover, unlike prior devices for in-folding the gusset tips, the present pre-folder 12 is positioned prior to (upstream of) the heater 32. As such contact with the carton material is carried out at a point in the process when the carton material is "cold", that is the material has not yet been heated and softened.

This positioning of the pre-folder 12 is advantageous in that it precludes accumulation of the softened polymer coating on the machine parts. In addition, it has been observed that the pre-folding is sufficient to tend the panels or flaps 104, 106 in toward one another to properly fold the flaps (during the folding process to form the bottom), but also sufficiently return the flaps to a substantially erect tubular form for receipt of the carton C at the heater 32.

Figure 5:
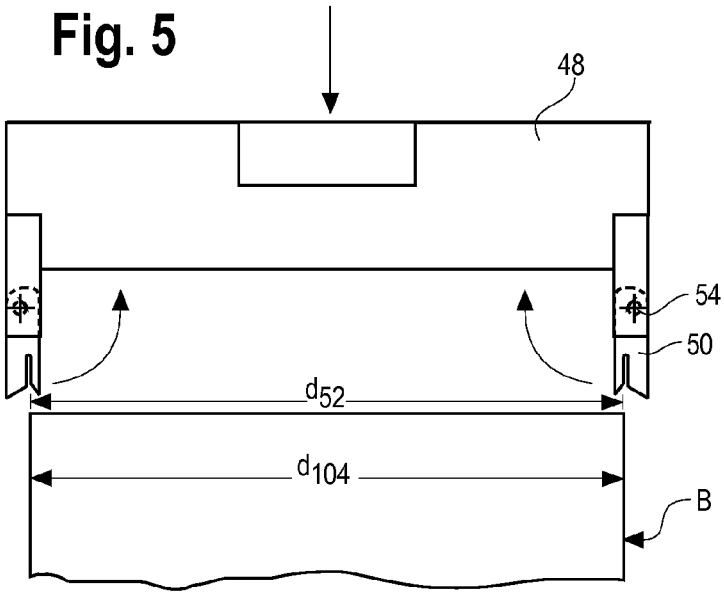
FIG. 5 is an illustration of the forming arm and the movement of the arm and the fingers.
Figure 6A:
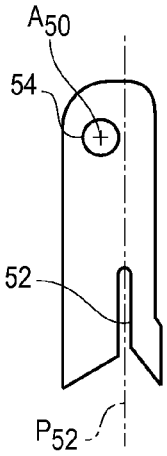
FIG. 6 is an illustration of the finger element removed from the arm.
Figure 6B:
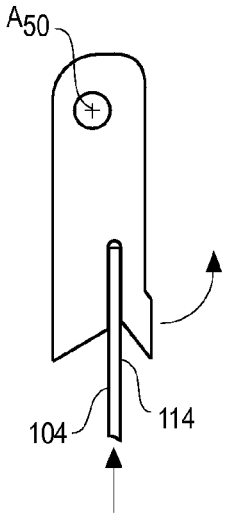

Referring to FIGS. 4-7, the pre-folder assembly 12 includes first and second (upper and lower) folding arms 40, 42 each having a flap contact head 44, 46, and a forming arm 48. The folding arms 40, 42 rotate such that the respective heads 44, 46 contact and pre-fold the leading and trailing panels 106*a,b* and the forming arm 48 pre-folds the gusset panel tips 110 (by prefolding at crease lines 124, 126 and 128). The forming arm 48 includes a pair of pivoting finger elements 50 mounted thereto. The finger elements 50 include carton engaging portions 52, which in a present configuration are configured as receiving slots. In an at rest state, as seen in FIG. 5, the slots 52 are parallel to one another and align with the carton C that is positioned for prefolding. The finger elements 50 are spaced so that the slots 52 are spaced a distance $d_{52}$ from one another about equal to a distance $d_{104}$ between the upstanding carton walls at the gusset panels 104. The finger elements 50 pivot about pins 54 (along a pivot line $A_{50}$) that are disposed outwardly of the slots 52 (see FIGS. 6 and 6A).

Figure 7:
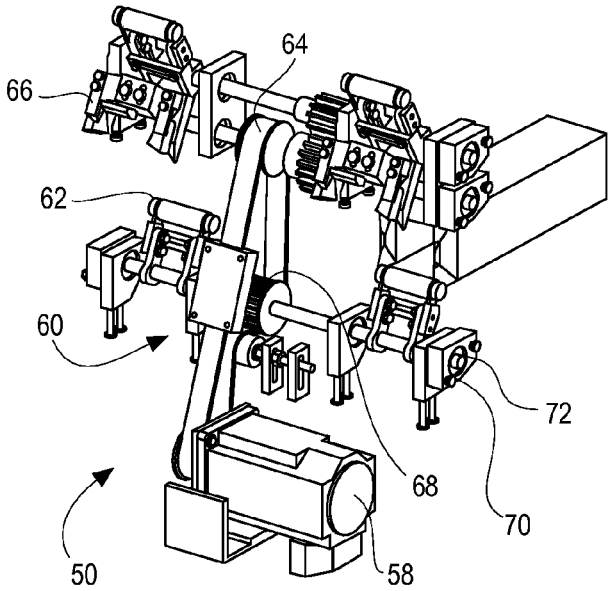
FIG. 7 illustrates the prefolder drive system.
Figure 8:
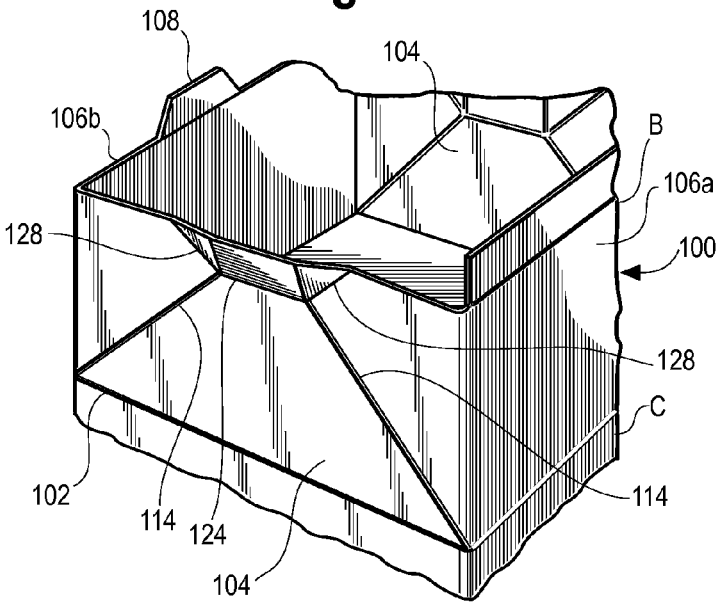
FIG. 8 is a partial perspective illustration of the bottom of a carton configured having infolded gusset tips.
Figure 9:
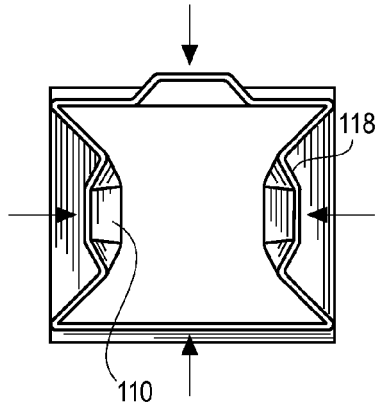
FIG. 9 is a bottom view of the carton in a partially folded configuration.
Figure 10:
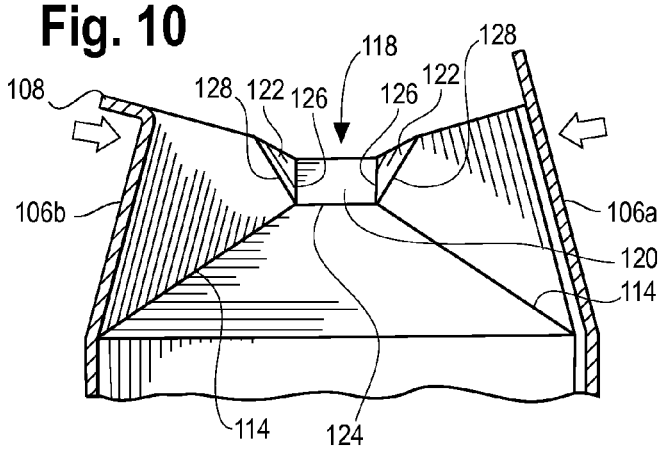
FIG. 10 is a side view of the prefolding of the carton bottom flaps.

Referring now also to FIG. 7, the assembly 12 includes a drive 56, such as the illustrated motor 58 and transmission 60. The transmission 60 includes a drive belt 62 that engages a drive gear or roller 64 on an upper folding arm drive subassembly 66, and a gear or roller 68 on a lower folding arm drive subassembly 70. The lower arm subassembly 70 includes a shaft 72 that is operably connected to the motor 58 by the gear 68 and belt 62. In this manner, actuation of the motor rotates the shaft 72 which in turn rotates the lower arm 42. As the lower arm 42 rotates, the head 46 contacts the bottom flap (in the illustrated embodiment, the trailing flap 106*b*) to pre-fold the flap.

In conjunction with pre-folding (of the trailing flap 106*b*) by the lower arm 42, the upper arm 40 rotates in an opposite direction and the head 44 contacts the leading flap 106*a* to pre-fold that flap. The upper arm 40 is formed as part of a subassembly 66 that includes first and second shafts 74, 76 operably connected to one another and operably connected to the motor 58 by the drive belt 62. The forming arm 48 is likewise connected to the motor 58 by the drive belt 62. The upper arm and forming arm drive shafts 74, 76 are operably connected to one another such that one of the shafts (e.g., the forming arm shaft 74) is directly driven by the drive belt 62 and the other shaft (e.g., the upper arm shaft 76) is driven by gearing 78 between the shafts 74, 76. In this manner, the upper and lower subassemblies 66, 70 are geared together. As will be appreciated by those skilled in the art, the details of the drive 56 or gearing can and very well may vary from that shown and described, and any such changes and/or modifications are within the scope and spirit of the present invention.

The forming arm 48 rotates about its axis $A_{48}$, in toward the gusset flaps 104. The finger elements 50, which are pivotally mounted to the arm 48 and extend forwardly of the arm 48, each includes the slot or channel 52 in which the gusset panel 104 is received at the in-folded region 118. As set forth above, the finger pivot axis or pivot line $A_{50}$ is outward of the plane $P_{52}$ of the slot 52. As a result, as the arm 48 rotates toward the carton C and the fingers 50 insert over the edges of the gusset panel flaps 104, the force exerted by the engagement of the flaps 104 and the fingers 50 (at the slot 52) will tend to urge the fingers 50 to pivot inwardly (see, FIG. 6A). This causes the flaps 104 to be pre-folded (along the crease lines 114, 124, 126, 128) outwardly at the edges, as the gusset panels 104 are folded inwardly (see FIGS. 8-9). It will be appreciated that the carton flaps at the gusset panels 104 insert into the slots 52, up to about crease line 124, such that the crease line 124 is at about the end of the finger 50 (see FIG. 6A).

As set forth above, it is important that the cartons are returned to the tubular shape (that the panels 100 are essentially folded back out) to facilitate heater 32 positioning the carton bottom B. To this end, the finger elements 50 are biased outwardly to the at rest position (the position illustrated in FIG. 6) in which the slots or channels 52 are aligned with the panels 104. As such, when the forming arm 48 cycles, the slots 52 are aligned with the carton edges at panels 104, the arm 48 continues inward toward the carton C and the fingers 50 insert over the carton edges, the arm 48 continues further inward movement which pivots the fingers 50 inward (to fold the panels 104), the arm 48 then reverses and, as the arm 48 moves away from the carton C, the fingers 50 return to their at rest state and the carton panels 100 return to the tubular shape.

It will also be appreciated that although a rotating motion for the forming arm 48 (and general rotational motion of carton forming) is disclosed, straight-line machine motions may also be used to, for example, bring the finger elements 50 into contact with the carton gusset panel flaps 104. All such motions are within the scope and spirit of the present invention.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A bottom prefolding assembly for prefolding bottom panels of a package having a bottom wall formed along preformed creases, the bottom wall having gusset tips, the bottom prefolding assembly configured to infold the bottom gusset panels, leading panels and trailing panels of a carton and to in-fold the gusset panel tips of the bottom wall prior to forming a sealed carton bottom, the package being disposed on a rotating turret having a path that defines a plane, the bottom prefolding assembly comprising:

a drive;

first and second folding arms configured to contact the leading and trailing panels of the bottom wall and inwardly prefold the lead and trailing panels toward the carton bottom wall configuration, the first and second folding arms being operably connected to the drive; and a forming arm operably connected to the drive and movable with the first and second folding arms, the forming arm having a pair of pivotable finger elements mounted thereto, the finger elements each having a carton engaging portion to engage the panel portions forming the gusset tips and fold the panel portions forming the gusset tips in a direction opposite of the folding of the gusset panels;

wherein the forming arm rotates about an axis and wherein the finger elements each pivot about axes, the finger elements' axes being parallel to and spaced from one another and being generally transverse to the forming arm axis.

2. The bottom prefolding assembly in accordance with claim 1 wherein the finger elements are formed having a slot region for receiving the panel portions that form the gusset tips.

3. The bottom prefolding assembly in accordance with claim 2 wherein the slot regions define spaced apart, parallel planes in which the panel portions that form gusset tips lie and wherein the planes do not intersect axes about which the finger elements pivot.

4. The bottom prefolding assembly in accordance with claim 3 wherein the finger elements are biased outwardly to align the slot regions with the panel portions the form the gusset tips when the panel portions are in a non-folded state.

5. The bottom prefolding assembly in accordance with claim 1 including a drive linkage operably connecting the drive to the first and second folding arms and the forming arm.

6. The bottom prefolding assembly in accordance with claim 5 wherein the first and second folding arms are disposed to rotate about axes spaced from and parallel to one another.

7. The bottom prefolding assembly in accordance with claim 6 wherein the forming arm is disposed to rotate about an axis spaced from and parallel to the first and second folding arm axes.

8. The bottom prefolding assembly in accordance with claim 5 including a flexible drive element engaging the first or second folding arm and the forming arm and wherein the other of the first or second folding arm is operably connected to the forming arm.

* * * * *